US006166175A

United States Patent [19]

Jung et al.

[11] Patent Number: 6,166,175

[45] Date of Patent: Dec. 26, 2000

[54] PARA-FULLY AROMATIC POLYAMIDE PULP, AN APPARATUS FOR PRODUCING THEREOF AND A PROCESS OF MAKING THEREOF

[75] Inventors: Kil Yeong Jung, Kumi; Won Jun Choe, Taegu; Jong Cheol Kim, Taegu; In Sik Han, Taegu; Hyeong Rak Lee; Hyung Don Huh, both of Kumi, all of Rep. of Korea

[73] Assignee: Kolon Industries, Inc., Kyunggi-do, Rep. of Korea

[21] Appl. No.: 09/254,862

[22] PCT Filed: Sep. 23, 1997

[86] PCT No.: PCT/KR97/00181

§ 371 Date: Jul. 19, 1999

§ 102(e) Date: Jul. 19, 1999

[87] PCT Pub. No.: WO98/13548

PCT Pub. Date: Apr. 2, 1998

[30] Foreign Application Priority Data

| | | | |
|---|---|---|---|
| Sep. 24, 1996 | [KR] | Rep. of Korea | 96/41801 |
| Nov. 14, 1996 | [KR] | Rep. of Korea | 96/53872 |
| Sep. 9, 1997 | [KR] | Rep. of Korea | 97/46313 |
| Sep. 9, 1997 | [KR] | Rep. of Korea | 97/46314 |

[51] Int. Cl.[7] ..... C08F 6/00

[52] U.S. Cl. ..... 528/502

[58] Field of Search ..... 528/502

[56] References Cited

U.S. PATENT DOCUMENTS

| | | | |
|---|---|---|---|
| 3,869,430 | 3/1975 | Blades | 264/203 |
| 4,511,623 | 4/1985 | Yoon et al. | 428/359 |
| 5,028,372 | 7/1991 | Brierre et al. | 264/148 |

FOREIGN PATENT DOCUMENTS

| | | |
|---|---|---|
| 9519466 | 7/1995 | WIPO . |
| 9527750 | 10/1995 | WIPO . |
| 9706204 | 2/1997 | WIPO . |

*Primary Examiner*—Terressa M. Boykin
*Attorney, Agent, or Firm*—Birch, Stewart, Kolasch, & Birch LLP

[57] ABSTRACT

The present invention relates to a para-fully aromatic polyamide pulp, its preparing process and its preparing equipment, more particularly, it is assemble of micro fibrils having less than 1 $\mu$m in its average diameter and crushed oval shaped cross-section wherein the longest distance is at least 1.2 times than the shortest distance.

Also, the present invention relates to a continuous process and equipment preparing for the above aromatic polyamide pulp by orienting and maturing or orienting, maturing and cutting the pre-polymer (non-oreinted) that aromatic diamine has been reacted with equivalent mole of aromatic diacid chloride in polymerization solvent.

21 Claims, 7 Drawing Sheets

PARA-FULLY AROMATIC POLYAMIDE PULP, AN APPARATUS FOR PRODUCING THEREOF AND A PROCESS OF MAKING THEREOF

This application is the national phase under 35 U.S.C. §371 of prior PCT International Application No. PCT/KR97/00181 which has an International filing date of Sep. 23, 1997 which designated the United States of America.

BACKGROUND OF THE INVENTION

1. Technical Field

The present invention relates to a para-fully aromatic polyamide pulp, its preparing process and its preparing equipment, more particularly, the pulp is composed of micro fibrils having less than 1 μm in its average diameter, and the pulp has a crushed oval shaped cross-section wherein the longest distance is at least 1.2 times than the shortest distance.

Also, the present invention relates to a process and apparatus for preparing the above pulp, more particulary, continuously orienting and maturing or orienting, maturing and cutting the pre-polymer (non-oreinted) that aromatic diamine-has been reacted with equivalent mole of aromatic diacid chloride in polymerization solvent.

Aromatic polyamide pulp is used as substitution of asbestos. It's usage are the substitution of asbestos in resin reinforcement, autoparts, gasket, pump packing, disk or drum brake, locomotive brake block, industrial brake, clutch facing, brake lining, friction material and construction material such as cement reinforcement.

Though each of the required properties in these adopted fields may differ. We take a more serious view in how much of the pulp is fibril and what is the length distribution of the fibrils. In case it is used as friction material, it is basically required to have excellent heat-resistance in order to endure heat generated from an instant friction. As it is used as packing or gasket, the restoration stability after compression is regarded important. This restoration stability is totally rely on the elasticity of pulp.

2. Description of the Related Art

Conventional preparing process of aromatic polyamide pulp and are examined in detail hereunder.

In U.S. Pat. No. 3,869,430, an aromatic polymer has been prepared by polymerizing an aromatic diamine and an aromatic diacid chloride in mixed solvent. One dissolves the resulting polymer in strong sulfuric acid to obtain a spinning liquid dope. One then extrudes it through a spinneret and finally coagulating it to prepare a filament. Normally, the preparing process of aromatic polyamide pulp is to cutting spinned filament, and refining in wet conditions to prepare a fibril developed aromatic polyamide pulp. In other word, develop fibril by damaging the surface of filament during refining process. As for the aromatic polyamide pulp prepared in this method, there has been a problem of limitation in pulp cross-section area. It is known that the spinned filament is normally 12 micrometer. The pulp cross-section obtained from cutting and refining of the aforesaid filament would have an almost round shape. Also, the cross-section area could not be more than that of original filament. When the pulp cross-section is round shaped, it has less contact area with resin than that of a crushed oval shape, and it's usability with resin will be lowered due to the low friction coefficient based on a jagged part.

As disclosed in U.S. Pat. No. 4,511,623, adds pyridine into the mixed polymerization solvent which polymerizes aromatic diamine with an aromatic diacid chioride, and then matures the polymer by leaving it 5 hours in normal temperature. One prepares polyamide pulp by grinding matured polymer. Even though this method makes it possibe to produce aromatic polyamide pulp without difficult and complicated spinning process, noxious pyridine has to be used in this method. At the same time, there is a process problem of polymer gellation during short time.

The pulp that has been prepared in this method, is composed of average diameter 2 μm crushed oval shape fibril. The cross-section of pulp is a crushed oval shape akin to round, and both ends of pulp are needle shaped. Aforesaid "crushed oval shape akin to round" means the longest distance of cross-section is less 1.2 times than the shortest distance of cross-section. The cross-section of each fibrils, which form pulp, are crushed oval shaped and the longest distance of fibril surface is at least 1.2 times than the shortest distance of fibril surface. However, the cross-section of pulp, the aggregation of fibrils, is crushed oval shape akin to round.

As a result of this fact, the usability with resin would be improved due to increased contact with resin and lower friction coefficient of jagged parts than perfectly round shaped of pulp. But, the aforesaid effects would be less than perfectly crushed oval shaped of pulp. Consequently, heat transmission, heat proliferation, impact-resistance and dispersion, etc would be deteriorated in the end use.

In U.S. Pat. No. 5,028,372, one prepares a pre-polymer by reacting an aromatic diamine with an aromatic diacid chloride in a mixed solvent, and orienting the pre-polymer in multi-hole die. One cuts the pre-polymer after 2~8 minutes of maturing at 25~60° C., and then matures the gel until it gets hard. After more than 90 minutes of maturing, shatters the hardened gel. maturing is performed in normal air or nitrogen air.

This preparing method was also a trial to eliminate the spinning process of dissolving polymer in sulfuric acid. In this method, however, a doubt of manufactural continuity has been brought up, and the property of pulp prepared in this method is remarkably lower than the property of pulp wherein pyridine was used as disclosed in U.S. Pat. No. 4,511,623. A report has been made that the pulp having these low properties can be used in an adopted field which apply the pulp obtained from filament.

SUMMARY OF THE INVENTION

The present invention relates to a new aromatic polyamide pulp composed of less than 1 μm average diameter micro fibril, crushed oval shaped cross-section, optical properties such as refractive index and color, and its preparing process and its preparing equipment. The aromatic polyamide pulp of the present invention could be prepared in conituously, and produced by polymerization and orientation at the same time. In other word, the spinning process of utilizing sulfuric acid during preparing process will be curtailed.

The aromatic polyamide pulp of present invention is composed of less than 1 μm average diameter micro fibril, has crushed oval shaped cross-section area, and the longest distance of cross-section is at least 1.2 times than the shortest distance of cross-section.

Also, the lateral facets of aromatic polyamide pulp of present invention is flat structure in both ends as FIG. 4, and several fibrils are branched out from the stem of pulp.

On the other hand, the interference fringe of parallel direction refraction index ($n_{||}$) against pulp axies of aromatic polyamide pulp in the present invention and that of vertical direction refraction index ($n_{\perp}$) are unsymmetrical and the peak irregular.

As the length of aromatic polyamide pulp of present invention, is longer than the longest distance of cross-section, the aromatic polyamide pulp has basically not only excellent properties of heat-resistance and restoration against compression when it is used as asbestos substitute, but also has the advantages of low friction coefficient and abrasion ratio at the same time.

Also, present invention relates to a process and apparatus of continuous orienting and maturing or orienting, maturing and cutting pre-polymer (non-oriented polymer) wherein aromatic diamine has been reacted with equivalent mole of aromatic diacid chloride in polymerization solvent.

The present invention provides a process for preparing aromatic polyamide pulp characterized by comprising the following steps:

(A) Mix and orient through suppling aromatic polyamide pre-polymer in orientation container (10) which is installed an orientation impeller (9) rotating by orientation moter (7), and placed at mixing and initial orientation zone (I), (B) Continuously orient through moving orientation container (10) sequentially which is locating at mixing and initial orientation zone (I) to orientation zone by orientation container moving cylinder (8), (C) Maturing through moving orientation container (10) sequentially which has been oriented at orientation zone to maturity zone by orientation container moving cylinder (8), (D) Separate matured polymer from orientation container (10) at final maturity zone, then return the separated orientation container (10) to mixing and initial orientation zone (I), (E) Cutting orientation polymer (15) continuously or discontinuously from above process.

The present invention provides a equipment for preparing aromatic polymide pulp characterized by comprising the folowing means:

(A) Mixing-means composed of orientation impeller (9), orientation motor (7) rotating orientation impeller (9) in high speed, and fixed frame of orientation impeller (14).

(B) Continuous moving-means composed of several orientation containers (10) which is movable to orientation zone and maturity zone containing pre-polymer, orientation container moving cylinder (8) shifting orientation container to right, left, upward, downward, and orientation container guidance board (16).

(C) Heating and cooling solvent circulation-means composed of (i) a cooling solvent supplying valve (17) providing cooling solvent to a jacket of orientation container guidance board (16) placed at orientation zone, (ii) a cooling solvent exhausting valve (17') ejecting cooling solvent provided at jacket, (iii) heating solvent supplying valve (18) providing heating solvent to a orientation container guidance board (16) placed at maturity zone and jacket of maturing/and high stirring pole (13), and (iv) a heating solvent exhausting valve (18') ejecting heating solvent provided at jacket.

(D) Selectively cutting-means which is installed under the maturity zone for cutting the orientation polymer (15).

BRIEF DESCRIPTION OF THE DRAWING

In FIG. 11, 6: pre-polymar, 7: orientation motor, 8: orientation container moving cylinder, 9: orientation impeller, 10: orientation container, 11: straighted knife cylinder, 12: squared knife, 13: maturing and high stirring pole (stirrer), 14: fixed frame of orientation impeller, 15: orientation polymer, 16: orientation container guidance board, 17: cooling solvent supplying valve, 17': cooling solvent exhausting valve, 18: heating solvent supplying valve, 18': heating solvent exhausting valve, 19: amputated orientation polymer, 20: shattering prevention jaw of polymer, 21: waist part of curive, 22: straighted knife, I~II: orientation zone, IV~VI: maturity zone.

DETAILED DESCRIPTION OF THE INVENTION

Figure 1:
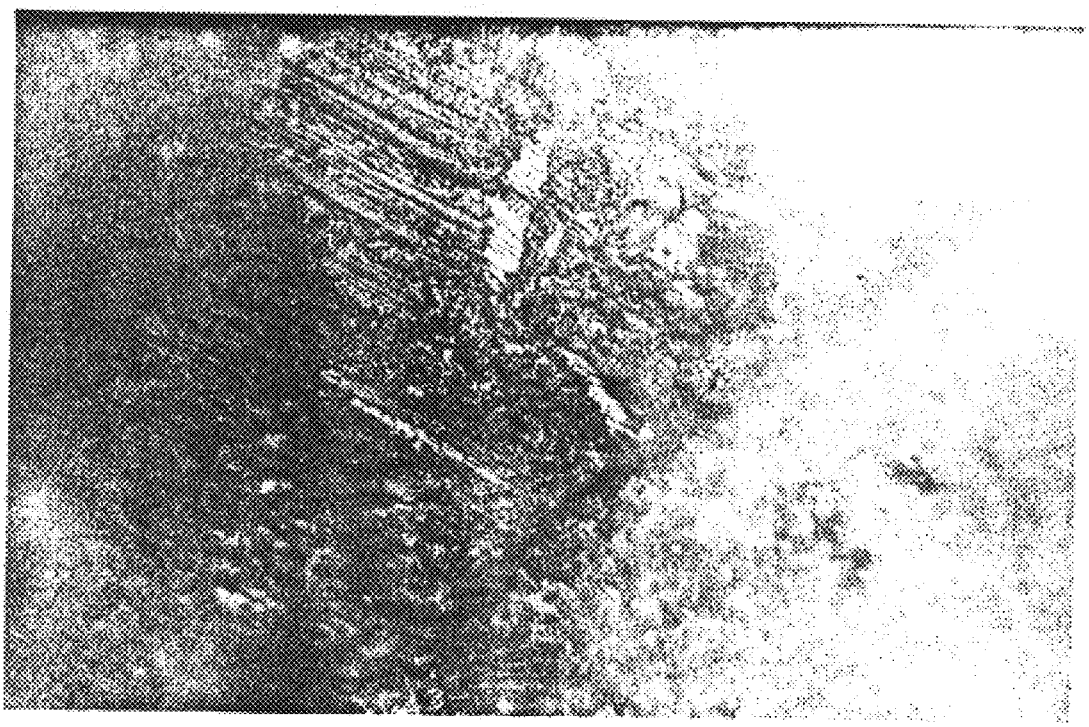
FIG. 1 and FIG. 2 are cross-section photographs of para-fully aromatic polyamide pulp of the present invention
Figure 2:
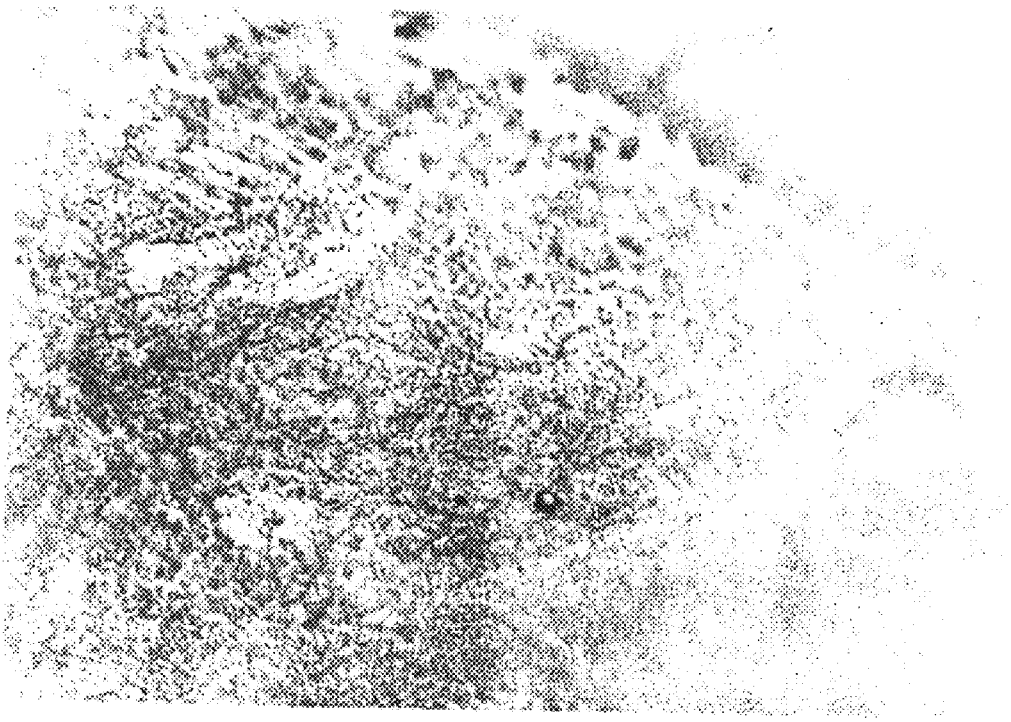
Figure 3:
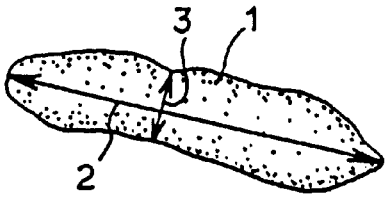
FIG. 3 is a cross-section depiction of para-fully aromatic polyamide pulp. Represented 1 in FIG. 3 is micro fibril which constitute the cross-section area, represented 2 is the longest distance of cross-section and 3 is the shortest dustance of cross-section.
Figure 4:
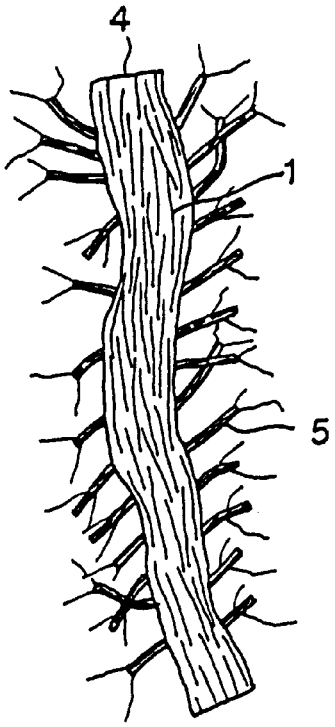
FIG. 4 is a lateral structure depiction of para-fully aromatic polyamide pulp. Represented 1 in FIG. 4 is fibril which constitute pulp, 4 is Stem of pulp and 5 is branched fibril from Stem of pulp.

The present invention relates to a new para-fully aromatic polyamide pulp, its preparing process and its preparing equipment, differentiating with conventional aromatic polyamide pulp in color and optical properties such as refraction index, characterized that it is assemble of micro fibril having less than 1 $\mu$m in its average diameter and has crushed oval shaped cross-section.

The present invention provides a orienting and maturing process fully detail as follow:

(A) Mix and orient through suppling aromatic polyamide pre-polymer in orientation container (10) which is installed an orientation impeller (9) rotating by orientation moter (7), and placed at mixing and initial orientation zone (I), (B) Continuously orient through moving orientation container (10) sequentially which is locating at mixing and initial orientation zone (I) to orientation zone by orientation container moving cylinder (8), (C) Maturing through moving orientation container (10) sequentially which has been oriented at orientation zone to maturity zone by orientation container moving cylinder (8), (D) Separate matured polymer from orientation container (10) at final maturity zone, then return the separated orientation container (10) to mixing and initial orientation zone (I), (E) Cutting orientation polymer (15) continuously or discontinuously from above process.

The orienting, maturing equipment or orienting, maturing, cutting apparatus for para-fully aromatic polyamide pulp of present invention is a assemble of the following means:

(A) Mixing-means composed of orientation impeller (9), orientation motor (7) rotating orientation impeller (9) in high speed, and fixed frame of orientation impeller (14).

(B) Continuous moving-means composed of several orientation containers (10) which is movable to orientation zone and maturity zone containing pre-polymer, orientation container moving cylinder (8) shifting orientation container to right, left, upward, downward, and orientation container guidance board (16).

(C) Heating and cooling solvent circulation-means composed of (i) a cooling solvent supplying valve (17) providing cooling solvent to a jacket of orientation container guidance board (16) placed at orientation zone, (ii) a cooling solvent exhausting valve (17') ejecting cooling solvent provided at jacket, (iii) heating solvent supplying valve (18) providing heating solvent to a orientation container guidance board (16) placed at maturity zone and jacket of maturing/and high stirring pole (13), and (iv) a heating solvent exhausting valve (18') ejecting heating solvent provided at jacket.

(D) Selectively cutting-means which is installed under the maturity zone for cutting the orientation polymer (15).

There are two kinds of cutting means of the above process as follow:

Straighted knife cylinder (11) and straighted knife (22) which cut oriented polymer (15) vertically against its progressive direction, and Squared knife (12) installed in lower part of straighted knife cylinder (11) which cut oriented polymer (15) horizontally against its progressive direction.

More particularly, continuous orientation-maturing system of present invention, is consist of same body essentially, whereas separation and cutting system would be consist of same body with above orientation-maturing system, or would not selectively.

It would be favorable that orientation zone and maturing zone are consist of 2~10 steps. The more steps of orientation zone and maturing zone, the better property of product. For the efficient operation and installation, less than 10 steps would be recommandable,. The present invention, however, does not especially restricts the steps of orientation zone and maturing zone.

Orientation impeller (9) for orienting and maturing provides shear-force by rotating 300~1500 rpm preferably in orientation zone. For the purpose of controlling gelation time of polymer in orientation zone, a controlling system for exterior temperature of orientation container will be fixed. In other word, apply orientation container guidance board (16) as jacket in orientation zone, supply cooling solvent to above jacket through cooling solvent supplying valve (17) and exhaust cooling solvent from above jacket through exhausting valve (17').

Install maturing and high stirring pole (13) [hereinafter referred to as "stirrer"] in maturing zone. If Orientation impeller (9), rotates from upper part to lower part as unified style, the oriented polymer could be damaged sustaining transformation of polymer interior in maturing zone. In order to prevent this damage, the orientation impeller (9) was designed not to contacted with polymer in maturing zone as FIG. 11. In other word, the maturing and stirrer (13) could heat the orientation impeller (9) with winding at the same time. The maturing and stirrer (13) was installed in a fixed portion. Shattering prevention jaw of polymer (20) was set up in order to protect inflow of polymer between orientation impeller (9) and maturing and stirrer (13). When the orientation polymer (15) moves from orientation zone to maturing zone.

For the sake of improving property of pulp and smoothing separation of polymer bsed on enough maturing, apply maturing and stirrer (13), orientation container guidance board (16) as jackeet, supply heating solvent such as steam or oil through heating solvent supplying valve (18), and then promote maturing. For smooth movement of orientation container in orientation zone and maturing zone, orientation container guidance board (16) is installed.

In case, the orientation zone, maturing zone, and cutting zone are installed in a body, it would be possible to cut oriented polymer continuously with the cutting system assembled with straighted knife (22) and squared knife (12) at straight knife cylinder (11) in final maturing zone (VI).

Figure 11:
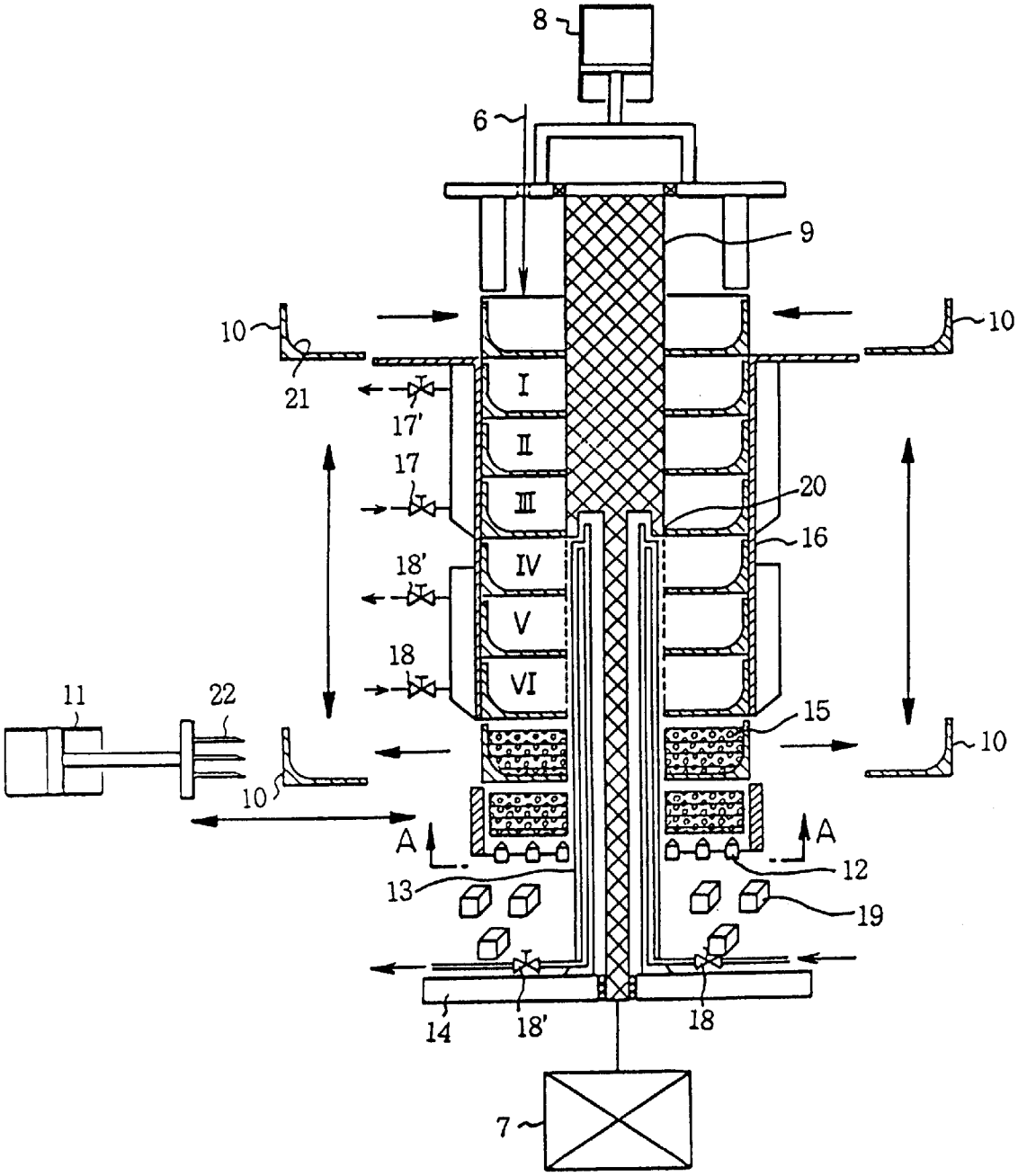
FIG. 11 is a rough-drawing of orienting, maturing, and cutting equipment utilizing in preparing para-fully aromatic polyamide pulp of the present invention.
Figure 12:
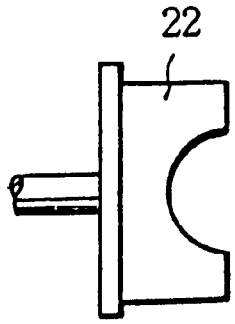
FIG. 12 is a plane drawing of straighted knife viewed from FIG. 11
Figure 13:
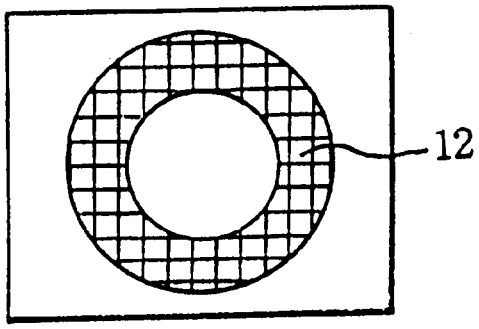
FIG. 13 is a bottom drawing of squared knife (No. 12 represented in FIG. 11) viewed from A—A line of FIG. 11

The circulation cycle process of present invention is explaned more particularly by FIG. 11.

Providing pre-polymer (6), non-oriented ploymer, continuously to cylinder-like orientation container (10) which is in mixing and initial orientation zone, mix and orient provided pre-polymer with orientation impeller (9) rotating by orientation motor (7). Once the pre-polymer provided some extent of inside height of cylinder-like orientation container (10), the orientation container moving cylinder (8) moves the orientation container (10) which is in mixing and initial orientation zone (I) to orientation zone (II). At the same time, orientation container system moves orientation container (10) which is in maturing zone (VI) to mixing and initial orientation zone (I) in order that new pre-polymer (6) could be provided. the orientation container finished orientation at orientation zone (I), will be moved sequentially to final orientation zone (III), maturing zone (IV)~(VI) by orientation container moving cylinder (8), then the orientation and maturing is processed simultaneously. By repeating these steps continuously, it has circulation cycle of mixing and initial orientation zone (I)→orientation zone (II)→final orientation zone (III)→maturing zone (IV)→maturing zone (V)→maturing zone (V).

When the maturing of polymer is completed at maturing zone (VI), oriented polymer (15) will be separated with orientation container (10). Separated orientation polymer (15) takes next series of cutting steps as follow:

a) Cutted vertically against progressive direction of polymer by straighted knife (22) fixed at straighted knife cylinder (11) of lower part of maturing zone., and b) Cutted horizontally against progressive direction of polymer by squared knife (12) fixed at lower part than the straighted knife (22).

The shape and property of aromatic polyamide pulp in present invention is described below more specifically.

The cross-section shape of Stem, forming aromatic polyamide pulp of present invention, is more like crushed oval shape than round shape. In this cross-section of pulp, therefore, there are the longest distance crossing center point, and the shortest distance, also. Measuring the longest distance and shortest distance could be easily analyze by utilizing IMAGE ANALYZER after cross-section survey.

Survey report of pulp cross-section obtained from present invention by IMAGE ANALYZER, the longest distance is normally 1.2 times at least than the shortest distance, even more it could be 30 times if the cross-section is fairly flat.

No spinning process, and no orientation during polymerization are why the cross-section of pulp has crushed oval shape other than round shape. Also, it is determined that micro fibrils, assembling pulp, wouldn't be separated one by one exactly if crush and refine the pulp in bulky condition. If the cross-section of pulp is examined precisely, it is not a cross-section of lump, but is bundle of micro fibrils which have less than 1 μm average diameter. The reason micro fibrils are not separated individually during crushing and refining, is —CO and —NH of polymer chains, composing micro fibrils, has hydrogen bonds mutually. If the hydrogen binding of micro fibril is not much, micro fibrils may be separated individually due to strong outer force during crushing and refining process. Plenty of hydrogen bonds among micro fibrils means the molecules of chains are well-oriented mutually in parallel. Since there are lots of hydrogen bonds in well-oriented chains like hereof, micro fibrils are enduring and not separated even though micro fibrils suffer from strong outer force during crushing and refining process.

In order to separate each individual micro fibril, strong forces have to be inflicted on boundary facet for breaking this strong hydrogen bonds among each micro fibrils. Practically however, it is not possible to inflict that strong forces on the boundary facet of tiny micro fibrils. If the micro fibrils are separated forcibly, cutting of micro fibrils by its length direction happens before the micro fibrils are separated. In this case, consequently, the length of fibril gets short, and it is hard to expect powerful combination when pulp is used as friction material or reinforcement material. Though the advancement of fibril is important role in using pulp, but froming plenty of fibrils in Stem which has some extent of length, is more favorable. That is to say, powerful combination could be borne by an entanglement among Stem and tiny fibrils.

Therefore, the length of pulp is favorable if it is same or longer than the longest distance of cross-section. Commonly, the length of pulp composing 10 times more than the longest distance of cross-section. It is called DEBRIS if the length of pulp is less than 10 times of the longest distance. If surveyed total pulp in bulky, this kinds of DEBRIS were always included. It's not economical to eliminate all DEBRIS completely. Also, small quantity of DEBRIS does not affect using aromatic polyamide pulp. The cross-section of micro fibril composing pulp is little different with the cross-section of pulp composing Stem. The cross-section of micro fibril is closer to round shape than the cross-section of pulp. Repeatedly, the ratio of longest distance to shortest distance of cross-section is almost 1.2, and it would not be found the ratio is more than 4.0.

The average diameter of micro fibril composing the pulp of present invention is less than I Am. Therefore, it is difficult to observe the cross-section of pulp in present invention cubically by photograph of optical microscope or scanning electron microscope. thus, the inventor of present invention made an experiment on observe the cross-section of pulp as follow:

a) Array pulp to a possible certain direction, dip in epoxy resin then cure.

b) cut this pulp in thin and observed the cross-section by optical microscope or scanning electron microscope. Thoroughly observed the photograph obtained from this steps by IMAGE ANALYZER.

The pulp cross-section consists of micro fibrils wherein its' average diameter is less than 1 μm and it has a crushed oval shape instead of a round shape. This property results from powerful hydrogen combination of micro fibrils and strong outer forces such as refining processes. The aromatic polyamide pulp of the present invention has a crushed oval-shaped cross-section and has a flated form on its lateral.

Also, the lateral facets of aromatic polyamide pulp of present invention has flat structure in both ends, and several fibrils are branched out from the stem of pulp. Branched fibrils are consist of micro fibrils. Accordingly, aromatic polyamide pulp of present invention has advantages in heat transmission or heat proliferation in using reinforcement of brake lining than conventional needle shaped structure, with such additional effects of absorption, mitigation and dispersion against impact.

Aromatic polyamide pulp prepared by present invention, has a specialty of cross-section shape as aforesaid. Observed the cross-section of said pulp more precisely, the longest distance crossing center of weight of cross-section is 3 to 500 μm ordinary. Provided that the observation includes micro fibril, the longest distance has a range of 0.12 to 500 μm. On the contrary, the shortest distance crossing center of weight of cross-section is 2 to 50 μm ordinary. Also, provided that the observation includes micro fibrils, the shortest distance has a range of 0.1 to 50 μm.

In order to survey the length of pulp, several experiments were made. In fact, since the form of pulp is crimped natually, it is very difficult work to measure exact length at present. Currently used alternative techinique is to select the pulp by each size utilizing different size of MESH and figure out fibril average length reversely.

According to J. E. TASMAN. TAPPI VOL. 55. NO. 1. 136–138 1972, a report has been made to figure out the length of fibrils selected by each MESH. According to the result of measured length distribution chart for pulp by BAUER McNETT method, aromatic polyamide pulp prepared in conventional preparing techinique includes about 10% fibrils smaller than 250 MESH. This kinds of very tiny particles would be formed if surplus outer force was inflicted extremely for fibrilization of pulp.

But in the pulp preparing method as present invention, wherein polymerization and orientation of aromatic polyamide are made simultaneously, tiny fibrils smaller than 200 MESH were contained less than 10% in most case since the the pulp takes outer force fairly during refine process which develops fibril. Quoting measured data from aforesaid REFERENCE, the 250 MESH is pertinent to 0.2 mm of fibril in length. As a matter of course, tiny fibrils smaller than 0.2 mm could be observed. These tiny fibrils however coule be disregarded as the quantity is so small.

Average fibril length of pulp could be measured statistically by applying length distribution program of using IMAGE ANALYZER after observation of dispersed sample by optical microscope.

Let's consider about the length is long. In process for preparing the present invention, wherein polymerization and orientation of aromatic polyamide pulp are made simultaneously, it is impossible to prepare ENDLESS FILAMENT obtained from spinning. In other word, it is impossible to prepare very long pulp. Long pulp prepared by present invention could be measured by eye. But this manual measure method might have about 10% error. It is confirmed that the longest pulp could be about 50 mm. In most case, the longest pulp is shorter than 30 mm. The length of pulp prepared by present invention could be ranged 0.2 mm 50 mm, and could be ranged 0.2~30 mm in most cases.

Provided that a pulp is prepared in conventional method of producing filaments by spinning the polymerized polymer after dissolving in sulfuric acid, the residual quantity of solvent will be quite little but there will be residual quantity of sulfate ammonium salt comparatively.

But a pulp is prepared by the method of presented invention, wherein polymerization and orientation of aromatic polyamide pulp are made simultaneously, there will be no the residual of sulfate ammonium salt as the process use no sulfuric acid. However, the residual of solvent and inorganic salt which were used for polymerization could be comparatively a lot. Normally used solvent for polymerization is a mixed solution of amid-based solvent and inorganic salt.

As the solvent and inorganic salt is not perfectly pure, the pulp would not be perfectly pure. These residual of solvent and inorganic salt could be controlled during process. In such purpose of deleting solvent less than 0.2% by washing perfectly, it would not be beneficial in view of industrial aspect. That means the increase of production cost.

For all that the cost, there are lots of solvent and inorganic salt residual due to rough washing, it may cause some problems in view of using pulp.

Measuring method for solvent residual is as following: Extract solvent residual of pulp applying an extracing solution such as water, and measure correct quantity by using Gas Chromatography.

It is not benificial in view of industrial if the residuum of amide solution is less than 0.2% during washing process. Though it is possible to leave more residuum than 0.2% corresponding to customer s demand, it is not desirable to leave more than this quantity of amide solution due to the 6% of moisture ratio. The residuum of inorganic salt which use for polymerization, could be reduced in proportion to the extent of amide solution extraction. It is also one of problems that how much the fibril of pulp should be developed.

In such purpose to prepare pulp by present invention, crushing (otherwise called "deflaking") and refining process should be performed, fibril development could be controlled in this process. In order to check the development of fibril, it would be best way to use optical microscope or scanning elecyron microscope.

Yet in this optical method, it is not possible to tell industrially the subtle difference of fibril development. So, pulp or paper manufacturing industry use CANADIAN STANDARD FREENESS (hereinafter referred to as "CSF") test normally for measuring fibril development.

CSF measurement is made with TAPPI STANDARD T227 om-85 method. Provide 3 g of pulp in 20° C. temperatured 1,000 ml water, and dissociate by 75,000 rotation in dissociater. Pour aforesaid dissociated contents into Freeness Tester of Draine Chamber, and measure the quantity of drainage from Side Orifice of lower part in Chamber.

It is known that current commercial aromatic polyamide pulp products of Du Pont Co. (product name: KEVLAR) and Akzo Co. (product name: TWARON) has CSF value ranging between 250 to 450.

At one time low CSF value meant that fibril was well developed. But, in that case, it was not good at water drain process. In order to produce excellent heat-resistance paper or sheet using aromatic polyamide pulp, sheet producing process is indispensable. And how well water drains is directly relates to the easiness of process. A pulp which has too low CSF value may cause increase of production cost because water does not drains well.

Aromatic polyamide pulp needs to be corresponding to user's request as general lumber pulp. If a pulp is prepared by the process of presented invention, wherein polymerization and orientation are made simultaneously, control property of final pulp by refining process, various pulp which has various CSF value could be prepared.

The property of aromatic polyamide pulp is not only decided by CSF value, but by length distribution, specific surface area, elasticity, density, and other heat properties. Necessary property will be chosen depends on how and which field pulp applied.

For instance, in adopted field such as brake pad or block, not only CSF value but the items such as heat properties, elasticity and specific surface area are also important. Users has no choice but to choose low CSF value product because of currently limited aromatic polyamide pulp puoduct has been commercialized such as KEVLAR (product name) of Du Pont Co. and TWARON (product name) of Akzo Co.

Even though aromatic polyamide pulp prepared in present invention has 700 CSF value level, it endures more than 500° C. similary to existing product, and it is possible to produce brake.

As a result of thorough observation experiments on refine process for reducing CSF value, it is confirmed to possible to lower than 100 CSF value. But the CSF value of aromatic polyamide pulp prepared by present invention is 200 to 800. It is most economical when the CSF value is 200 to 800.

Followings are the result of refraction index and multi-refraction index measured by Aus Jena Interparko:

It is possible to figure out average refraction index and birefringence of pulp by figuring parallel direction refraction index ($n_{||}$) against pulp axie of aromatic polyamide pulp and vertical direction refraction index ($n_{\perp}$). Refraction index represents optical property of pulp and birefringence (An) represents degree of moleclar orientation (include crystallization, non-crystallization).

parallel direction refraction index ($n_{||}$), vertical direction refraction index ($n_{\perp}$) against pulp axle and birefringence ($\Delta n$) are figured by next formulae $$n\|=\lambda F\|/hMA+n$$

$$n=\lambda F\perp/hMA+n$$

$$\Delta n=\lambda(F\|-F\perp)/hMA$$

In these formulae, $\lambda$ is wave of ray, $F\perp$ and $F\|$ are interference fringe moving areas of parallel and vertical refraction indexes against pulp axle, h is fringe Spacing, A is cross-section area of pulp, M is Magnification, n is refraction index of Immersion Oil.

Figure 5:
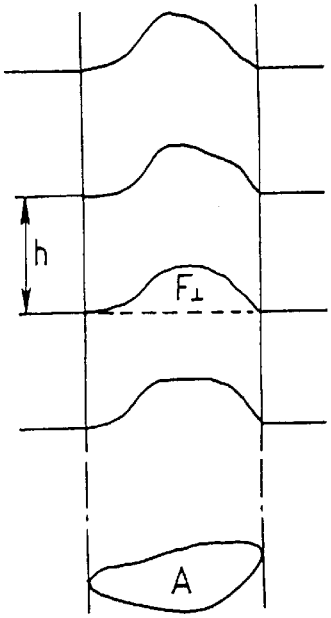
FIG. 5 is interference fringe of vertical direction refraction index ($n_{||}$) against pulp axis of aromatic polyamide pulp in the present invention.
Figure 6:
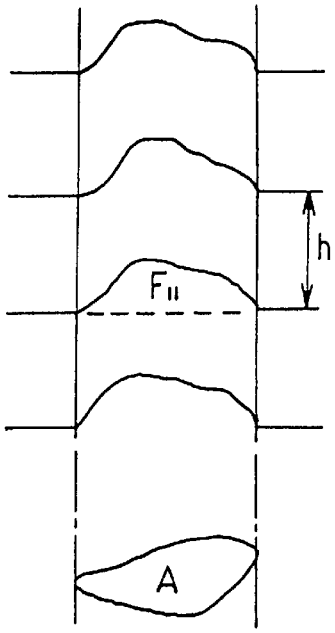
FIG. 6 is interference fringe of parallel direction refraction index ($n_{\perp}$) against pulp axis of aromatic polyamide pulp in the present invention.
Figure 7:
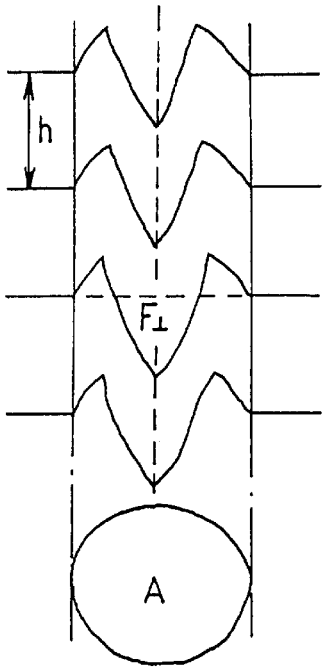
FIG. 7 is interference fringe of vertical direction refraction index ($n_{||}$) against pulp axis of conventional aromatic polyamide pulp (product of Du pont Co.). Represented A from FIG. 5 to FIG. 7 is cross-section area of pulp, h is fringe spacing, $F_{||}$ and $F_{\perp}$ are fringe shifting area respectively.
Figure 8:
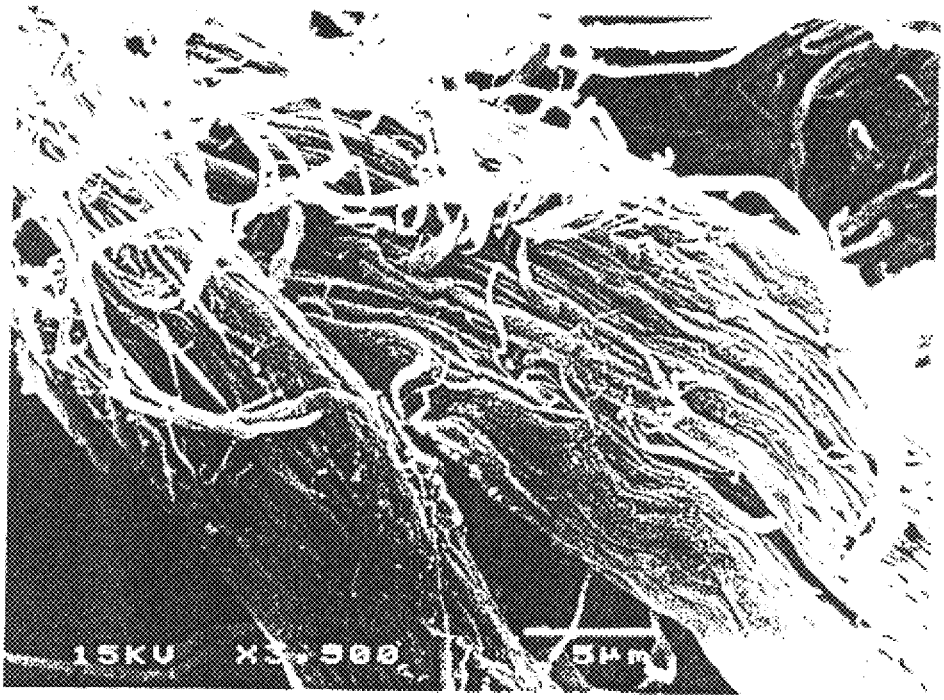
FIG. 8 is a scanning electronic microscope photograph of para-fully aromatic polyamide pulp of the present invention.
Figure 9:
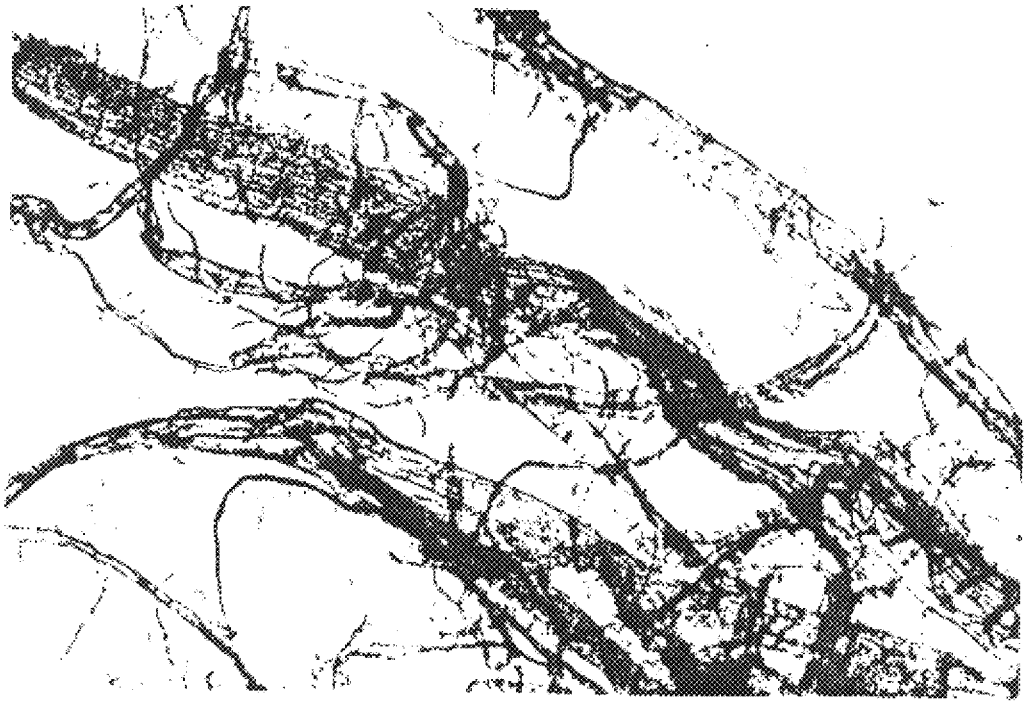
FIG. 9 is a optical microscope photograph of para-fully aromatic polyamide pulp of the present invention.
Figure 10:
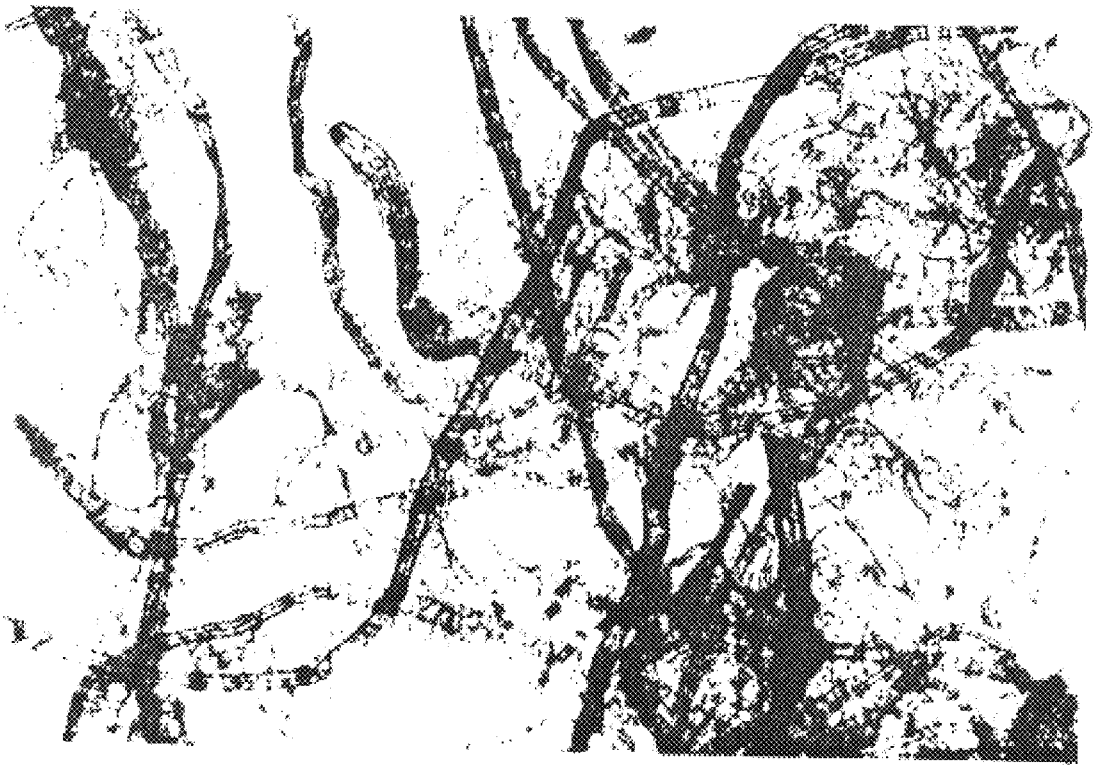
FIG. 10 is a optical microscope photograph of conventional aromatic polyamide pulp (product of Du pont Co.)

First of all, measure interference fringes of parallel and vertical refraction indexes against pulp axis by Immersion Oil method utilizing Interparko, figure out interference fringe moving area and cross-section area of pulp by Image Analyzer. 10 pulp samples of present invention selected by cross-section area distribution were measured by aforesaid measuring method about refraction index interference fringe, refraction index and birefringence. The interference fringe of vertical refraction index against pulp axie is as FIG. 5, and the interference fringe of vertical refraction index against pulp axie is as FIG. 6. Source of ray used in this measurement is white-colored ray with it's wave 550 nm.

The distribution of vertical refraction index ($n_{||}$) is 1.58 to 1.64, and the distribution of pararrel refraction index ($n_{\perp}$) is 2.11 to 2.23, and average refraction index is 1.80 The distribution of birefringence is 0.47 to 0.65.

The value of birefringence of pulp indirectly represents the orientation degree of molecule in fibrils. Provided that molecule are oriented well, dynamic property such as tenacity will be increased.

In order to measure the stability of pulp against ray, measurement has been made in UV rays and visible rays. That is to say, it was checked how the molecules of fibril were affected against rays.

Measurement of reflection index is made under 100~700 wave range applying UV-Visible Spectrometer model Shimadzu UV-260. Slice the sample pulp like sheet which has plane surface, and then measure by reflection device. Measure reflection ratio comparing Reference and samples. Reference is to reflect 100%.

RAY REFLECTION RATIO=(SAMPLE REFLECTION INDEX/REFERENCE REFLECTION INDEX)×100

Ray reflection ratio by range of visible rays are as following.

| | WAVE (nm) | | | | |
|---|---|---|---|---|---|
| ITEM | 150 | 400 | 500 | 600 | 700 |
| REFLECTION RATIO (%) | 0 | 10 | 47 | 64 | 81 |

No reflection ratio of UV rays range, but different reflection ratio by wave range of visible rays.

In general, molecules of fibril are decomposed infinitesimally by UV rays, and it may affects the dynamic propeerty. Upon aforesaid measurement result, there is almost no reflection ratio but absorb 100%. As the decomposition by UV rays range is infinitesimal, it may be applicable for UV rays protection materials for long time usage. Also, it would not a problem to be exposed to visible ray range as the reflection ratio is 81% when the wave is 700 nm.

The color of aromatic polyamide pulp prepared by present invention method, was measured as following by equipment model "DATA COLOR INTERNATIONAL SF 600". Equipment model "DATA COLOR INTERNATIONAL SF 600" is a 2-Channel Spectrophotometer designed to measure reflexibility and permeability by 10 nm interval within visible ray range (400~700 nm). It is possible to measure samples by size (Large: 30 nm caliber, Small: 12 nm caliber, Ultra Small: 6.5 nm caliber). Survey Reference and samples with source of ray D65/10, and perceive reflected ray from Reference and samples with two ray electrodes affixed at Analyzer, then measure these reflected rays by computer program. Measured data will be analyzed using International Color System.

The result values of that measurement are L: 80.0 to 82.1, a: 2.0 to 2.8, b: 23.0 to 23.4 (L means Lightness, a means +red, −blue, and b means +yellow, −blue).

By measuring the density of pulp, the degree of crystallization in fibril could be measured indirectly. The density of aromatic polyamide pulp prepared by present invention, was measured in U-style pipe method (Applied Heavy solution $CCl_4$, Light solution N-heptane, Standard Floator), and the density value of result is 1.40~1.43 ($g/^{cm3}$). It has lower density than 1.44 which is normally known. This seems to affect good for making the product light.

Measured the crystallization degree of aromatic polyamide pulp prepared by present invention, wherein contained 5% of moisture, using X-ray Diffractometer (WAXD), the crystallization degree value is 45% to 60%.

Dry up the pulp, and soak into water again. Then measured the crystallization degree of aromatic polyamide pulp prepared by present invention, wherein contained 50% of moisture using aforesaid method, the crystallization degree value is low much as 30% to 40%.

in ordinary concept, it was not easy to consider that the crystallization degree of aromatic polyamide pulp fluctuates depends on contained moisture. The reason for this fact is not known yet, but absorbed moisture again, then the crystallization degree fall down.

Also, the size of crystal could be measured by same aforesaid analyzer, the crystal size of plain (110) was shown 40 to 60 Å.

Crystal orientation of pulp could be measured in addition. The orientation angle of plain (110) is ranging 28 to 35°. This orientation angle was measured from sliced sheet-like polymer sample prepared in dried up after polymerization and orientation were made simultaneously, using X-ray Diffractometer (WAXD). Used TARGET for analysis is 1 mm in width and height. Practically observed this size area by optical microscope, and the array of fibril was not good enough. Therefore, the orientation angle of actual molecule level, the angle is expected to range lower than above. However, it is not possible to observe exact value range at present.

Specific surface area of aromatic polyamide pulp prepared by present invention was measured using Micromeritics (Flowsorb II 2300). This Specific surface area is applied to measure non-evened surface area of a material comparing to it's weight.

First of all, clear any moisture in U-style glass pipe by passing Nitrogen through, and measure exact weight of glass pipe.

Fill the glass pipe with sample, and figure out the weight of sample by measuring total weight.

By injecting nitrogen from one side end of U-style glass pipe wherein sample has been filled for a certain time, and exhausting the nitrogen through the other side end, nitrogen gas would be adherent to sample. By figuring out the nitrogen quantity of sample which has already absorbed nitrogen gas through aforesaid steps, the specific surface area of sample could be measured.

SPECIFIC SURFACE AREA ($^{m2}$/g)=SURFACE AREA ($^{m2}$)/SAMPLE WEIGHT (g)

The result measured in aforesaid method was 3~14$^{m2}$/g

The aromatic polyamide pulp which has these compound properties could be applied as asbestos substitute in such field as brake friction material and gasket.

It also would be possible for a pulp thicker than the range of present invention to prepare in same way with present invention wherein polymerization and orientation are performed simultaneously. In this case, that pulp would be efficient as asbestos substitute applied in such field as cement -reinforcement or adiabatic material, though fibril development would not be much expected.

EXAMPLE 1

After the temperature of a reactor in which 1,000 kg of N-methyl-2-pyrrolidone was added, was control led to 80° C., 80 kg of $CaCl_2$ was added thereto, stirred and completely dissolved.

To the above polymerization solvent was added 48.67 kg of melting P-phenylene diamine, stirred and dissolved to prepare the solution of aromatic diamine.

The above amine solution was added at the rate of 1128.67 g/min using a quantative pump to a mixer control led at the temperature of 5° C. using a temperature controller, and simultaneously melted Tereph-thaloyl Chioride was added thereto at the rate of 27.41 g/min and mixed and reacted to prepare the first mixed solution.

After controlling the temperature of the first mixed solution to 5° C., it was added into kneader, a continuous mixer, at the rate of 1156.06 g/min, and then more melted terephthaloyl was simultaneously added at the rate of 63.95 g/min to react in kneader.

Prepared non-oriented polymerization (pre-polymer) by intial mixing and polymerization in kneader, a continuous mixer. Pre-polymer (6), non-oriented polymer prepared from aforesaud step, was added continuously into orientation container (10) which is in mixing and initial orientation zone, and simultaneously reacted, mixed, oriented inputted polymer by rotating orientation impeller (9) at the speed of 420 RPM.

When certain quantity of polymer was added in orientation container (10) placed in mixing and initial orientation zone (I), oriented the polymer moving orientation container (10) orderly to orientation zone (II) and orientation zone (III) by orientation moving cylinder (8). At this step, the polymerization and orientation time should be 190 sec., and delayed polymer gelation by supplying water into jacket of orientation container guidance board (16) in orientation zone (I)~(III).

When orientation was completed in orientation zone (III), matured the polymer moving orientation container (10) orderly to maturing zone (IV), (V), and (VI) by orientation moving cylinder (8). At this step, maturing and high stirring pole (13) has been installed at maturing zone (IV)~(VI), and supplied steam into jackets of orientation container guidance (16), stirrer (13) at the same time for efficient maturing.

When maturing was completed in maturing zone (VI), separate polymer (15) with orientation container (10), and return the orientation container (10) to mixing and initial orientation zone (I) by orientation container moving cylinder (8).

Cut the said separated polymer (15) by 3 cm length with straighed knife (22) and squared knife (12) installed in the lower part of maturing zone (VI).

Soaked the said cutted polymer into 50° C. temperated water for 2 hours, and extract residual solvent inside of polymer by putting into water after crushing by hammer.

Subsequently, crushed with DISK MILL (made in German EIRICH SF-6) Thereafter, washed several times in order to extract residual N-methyl-2-pyrrolidone inside of polymer.

Then, in order to obtain final pulp, refined the slurry of said prepared pulp controlling its density at 1% using ANDRITZ SPROUT BAUER refiner. At this step, refiner interval is 7 MILS, and passed 20 times through.

After that, eliminate water from slurry and dried up.

Thereafter, spread the said fibril using DISK MILL for the purpose of producing para-fully aromatic polyamide pulp, wherein composed of micro fibrils having less than I Jim in its average diameter and crushed oval shaped cross-section.

The properties of said produced pulp are as following:

DENSITY 1.4322

SIZE OF CRYSTAL 51 Å

LONGEST DISTANCE OF CROSS-SECTION: 12~66 μm

SHORTEST DISTANCE OF CROSS-SECTION: 2~21 μm

LONGEST DISTANCE/SHORTEST DISTANCE OF CROSS-SECTION=1.2~30

MEASUREMENT OF LENGTH DISTRIBUTION (OVER 30 MESH): 18%

DEBRIS (UNDER 200 MESH): 10%

AVERAGE LENGTH: 1200 μm

EXAMPLE 2~7

A process for preparing aromatic polyamide pulp is same with EXAMPLE 1. Differentiate the providing quantity of shear force (RPM of Impeller), and total time of polymerization with orientation during process of polymerization and orientation after Kneader, a continuous mixer.

And then prepared aromatic polyamide pulp, wherein composed of micro fibrils having less than 1 μm in its average diameter and crushed oval shaped cross-section.

The properties of pulps prepared in these ways are as following.

| | METHOD | | PROPERTIES | | | | | | | |
|---|---|---|---|---|---|---|---|---|---|---|
| | ROTATION (RPM) | TIME OF POLYMERIZATION & ORIENTATION (sec) | DENSITY (g/cc) | LENGTH OF LONGEST (μm) | LENGTH OF SHORTEST (μm) | AVG. RATIO OF LONGEST/SHORTEST | AVG. LEHGTH OF FIBRIL (mm) | REFRACTION INDEX (VERTical | REFRACTION INDEX (PARALLEL) | CSF (ml) |
| EXAMPLE 2 | 700 | 150 | 1.423 | 7–179 | 2–12 | 5.8 | 1.8 | 1.59 | 2.12 | 390 |
| EXAMPLE 3 | 600 | 145 | 1.430 | 12–150 | 4–20 | 5.2 | 1.8 | 1.60 | 2.21 | 420 |
| EXAMPLE 4 | 500 | 151 | 1.430 | 9–190 | 4–15 | 6.2 | 1.9 | 1.62 | 2.19 | 410 |
| EXAMPLE 5 | 300 | 152 | 1.426 | 7–190 | 3–20 | 9.1 | 1.8 | 1.59 | 2.21 | 200 |
| EXAMPLE 6 | 200 | 162 | 1.428 | 9–120 | 4–19 | 2.4 | 1.6 | 1.58 | 2.21 | 520 |
| EXAMPLE 7 | 100 | 171 | 1.429 | 5–122 | 2–18 | 2.1 | 1.5 | 1.60 | 2.11 | 560 |

EXAMPLE 8~13

A process for preparing aromatic polyamide pulp is basically same with EXAMPLE 1. Conditioned 15 Mils of refiner interval during refining, differentiate the slurry density and refining times.

And then prepared aromatic polyamide pulp, wherein composed of micro fibrils having less than 1 μm in it's average diameter and crushed oval shaped cross-section.

The properties of pulps prepared in these ways are as following

| | METHOD | | PROPERTIES | | | | | | |
|---|---|---|---|---|---|---|---|---|---|
| | SLURRY DENSITY (%) | REFINE TIMES TIMES | LENGTH OF LONGEST (μm) | LENGTH OF SHORTEST (μm) | AVG. RATIO OF LONGEST/ SHORTEST | AVG. LENGTH OF FIBRIL (mm) | REFRACTION INDEX (VERTICAL) | REFRACTION INDEX (PARALLEL) | CSF (ml) |
| EXAMPLE 8 | 1.1 | 1 | 18–500 | 12–50 | 2.3 | 6.5 | 1.58 | 2.11 | 720 |
| EXAMPLE 9 | 1.2 | 3 | 15–460 | 10–45 | 2.5 | 3.8 | 1.59 | 2.20 | 640 |
| EXAMPLE 10 | 1.1 | 5 | 13–440 | 10–40 | 3.1 | 3.2 | 1.62 | 2.15 | 560 |
| EXAMPLE 11 | 1.2 | 7 | 12–400 | 8–35 | 4.6 | 2.8 | 1.61 | 2.22 | 450 |
| EXAMPLE 12 | 1.3 | 10 | 6–340 | 4–30 | 5.5 | 2.3 | 1.62 | 2.23 | 380 |
| EXAMPLE 13 | 1.2 | 20 | 4–260 | 3–20 | 5.2 | 1.9 | 1.63 | 2.18 | 250 |

Among the pulp of above mentioned EXAMPLES, adopt the pulp of EXAMPLE 12 for pruducing brake model as next steps.

Prepare a composition which is consist of 5% Pulp, 52% Dolomite, 12% Barum Sulfate, and 21% Cadolrite.

Afetr that, molded said composition for 30 minutes in temperature of 180° C. in order to produce brake model.

Following table is compared results in defacement ratio and friction coefficient of brakes which have been produced by utilizing aromatic polyamide pulp of present invention and existing aromatic polyamide pulp of Du Pont Co. (KEVLA).

| | PROPERTY ° C. | | | | | | | | | |
|---|---|---|---|---|---|---|---|---|---|---|
| | FRICTION COEFFICIENT | | | | | DEFACEMENT RATIO | | | | |
| PULP | 100 | 150 | 200 | 300 | 350 | 100 | 150 | 200 | 300 | 350 |
| PULP OF EXAMPLE 12 | 0.288 | 0.296 | 0.368 | 0.336 | 0.320 | 12 | 13 | 7 | 29 | 46 |
| KEVLAR (2 mm) | 0.288 | 0.296 | 0.344 | 0.328 | 0.312 | 12 | 18 | 8 | 32 | 58 |

Since the aromatic polyamide pulp of present invention is consist of micro fibrils having less than 1 μm in its average diameter and crushed oval shaped cross-section, it shows excellent usability with resin when it is used as resin reinforcement. As a result of this fact, abrasion ratio of brake is fall down.

As the said pulp has various CSF values, it could be applied with pertinent pulp selectively.

As the optical property is excellent additionally, decomposition by UV rays are remarkably decreased compared to existing pulp.

Also, the orientation, maturing and cutting equipment of present invention occupies small installation space, simplifies the process, and elevates productivity.

What is claimed is:

1. A para-fully aromatic polyamide pulp, comprising:

micro fibrils having less than 1 μm in its average diameter and having a crushed oval shaped cross-section, wherein the longest distance of the cross-section diameter is at least 1.2 times than the shortest distance of the cross-section diameter.

2. The para-fully aromatic polyamide pulp according to claim 1, wherein the longest distance of the oval shaped cross-section is 0.12 to 500 μm.

3. The para-fully aromatic polyamide pulp according to claim 1, wherein the shortest distance of the oval shaped cross-section is 0.1 to 50 μm.

4. The para-fully aromatic polyamide pulp according to claim 1, wherein the reflection ratio of pulp against UV rays is 0%.

5. The para-fully aromatic polyamide pulp according to claim 1, wherein the reflection ratio of pulp against visible rays is 10 to 85%.

6. The para-fully aromatic polyamide pulp according to claim 1, wherein the color of pulp measured by color meter is L: 80.0 to 82.1, a: 2.0 to 2.8, and b: 23.0 to 23.4.

7. The para-fully aromatic polyamide pulp according to claim 1, wherein the residual quantity of polymerization solvent is 0.2 to 6%.

8. The para-fully aromatic polyamide pulp according to claim 1, wherein the length of pulp is 0.2 to 50 mm.

9. A para-fully aromatic pulp, wherein the interference fringe of parallel direction refraction index ($n\|$) against pulp axis and the interference fringe of vertical direction refraction index ($n\perp$) against pulp axis are unsymmetrical, and the Peak is irregular.

10. The para-fully aromatic polyamide pulp according to claim 9, wherein the interference fringe of parallel direction refraction index (n‖) against pulp axis is 2.11 to 2.23.

11. The para-fully aromatic polyamide pulp according to claim 9, wherein the interference fringe of vertical direction refraction index (n⊥) against pulp axis is 1.58 to 1.64.

12. The para-fully aromatic polyamide pulp according to claim 9, wherein the reflection ratio of pulp against UV rays is 0%.

13. The para-fully aromatic polyamide pulp according to claim 1, wherein the reflection ratio of pulp against visible rays is 10 to 85%.

14. The para-fully aromatic polyamide pulp according to claim 1, wherein the color of pulp measured by color meter is L: 80.0 to 82.1, a: 2.0 to 2.8, and b: 23.0 to 23.4.

15. The para-fully aromatic polyamide pulp according to claim 9, wherein the residual quantity of polymerization solvent is 0.2 to 6%.

16. The para-fully aromatic polyamide pulp according to claim 1, or claim 9, wherein the Canadian Standard Freeness (CSF) is 200 to 800, and the specific surface area is 3 to $14m^2/g$.

17. An apparatus for preparing para-fully aromatic polyamide pulp comprising:

(A) a mixing means comprised of an orientation impeller (9) connected to an orientation motor (7) for rotating said orientation impeller (9) at high speed, and a fixed frame for an orientation impeller (14);

(B) a continuous moving means comprised of orientation containers (10) that move in an orientation zone and a maturity zone containing a pre-polymer, an orientation container moving cylinder (8) for shifting the orientation containers to the right, the left, upward or downward, and an orientation container guidance board (16);

(C) a heating and cooling solvent circulation means comprised of:

(i) a cooling solvent supplying valve (17) that provides cooling solvent to a jacket of the orientation container guidance board (16) placed at the orientation zone, (ii) a cooling solvent exhausting valve (17) that ejects cooling solvent provided at a jacket, (iii) a heating solvent supplying valve (18) that provides heating solvent to the orientation container guidance board (16) placed at the maturity zone and a jacket of maturing/and high stirring pole (13), and (iv) a heating solvent exhausting valve (18') that ejects heating solvent provided at a jacket;

(D) a selective cutting means that is installed under the maturity zone for cutting the orientation polymer (15).

18. The apparatus for preparing para-fully aromatic polyamide pulp according to claim 17, wherein said selective cutting means is comprised of:

a straighted knife cylinder (11), a straighted knife (22) that cuts the oriented polymer (15) vertically against the progressive direction of the oriented polymer (15), and a squared knife (12) installed in the lower part of straighted knife cylinder (11), which cuts the oriented polymer (15) horizontally against the progressive direction of the oriented polymer (15).

19. The apparatus for preparing para-fully aromatic polyamide pulp according to claim 17, wherein the maturing and high stirring pole (13) separated with the orientation impeller (9) is installed in the orientation container that is positioned at the maturing zone.

20. The apparatus for preparing para-fully aromatic polyamide pulp according to claim 17, wherein the heating solvent is steam or oil.

21. A process for preparing para-fully aromatic polyamide pulp comprising the steps of:

(A) Supplying an aromatic polyamide pre-polymer, obtained from an aromatic diamine reacted with an aromatic diacid chloride in a polymerization solvent, to an orientation container (10) that has an orientation impeller (9) that is rotated by orientation motor (7), said orientation container (10) is located at a mixing and initial orientation zone (I);

(B) continuously orienting pre-polymer by moving the orientation container (10) that is located at the mixing and initial orientation zone (I) sequentially to a orientation zone using orientation container moving cylinder (8);

(C) maturing polymer through moving the orientation container (10) that has been oriented at the orientation zone sequentially to a maturity zone using orientation container moving cylinder (8);

(D) separating matured polymer from orientation container (10) at final maturity zone, then returning the separated orientation container (10) to the mixing and initial orientation zone (I);

(E) cutting orientation polymer (15) continuously or discontinuously from above process.

* * * * *